US006985164B2

(12) United States Patent
Rogers et al.

(10) Patent No.: US 6,985,164 B2
(45) Date of Patent: Jan. 10, 2006

(54) METHOD AND SYSTEM FOR DRIVING A PIXEL

(75) Inventors: Gerald D. Rogers, Dallas, TX (US); Ronnie N. Dunn, McKinney, TX (US)

(73) Assignee: Silicon Display Incorporated, Richardson, TX (US)

( * ) Notice: Subject to any disclaimer, the term of this patent is extended or adjusted under 35 U.S.C. 154(b) by 287 days.

(21) Appl. No.: 10/302,562

(22) Filed: Nov. 21, 2002

(65) Prior Publication Data

US 2003/0103046 A1 Jun. 5, 2003

Related U.S. Application Data

(60) Provisional application No. 60/331,956, filed on Nov. 21, 2001.

(51) Int. Cl.
*G09G 5/10* (2006.01)

(52) U.S. Cl. ..... 345/692; 345/84

(58) Field of Classification Search ..... 345/87–89, 345/94, 690–693, 84–85, 204, 290–291; 359/290–291

See application file for complete search history.

(56) References Cited

U.S. PATENT DOCUMENTS

| | | | | |
|---|---|---|---|---|
| 4,779,083 A | * | 10/1988 | Ishii et al. | 345/692 |
| 5,293,482 A | | 3/1994 | Lambidakis | 395/164 |
| 5,414,442 A | * | 5/1995 | Yamazaki et al. | 345/89 |
| 5,416,496 A | * | 5/1995 | Wood | 345/102 |
| 5,497,172 A | | 3/1996 | Doherty | 345/85 |
| 5,522,082 A | | 5/1996 | Guttag et al. | 395/800 |
| 5,675,361 A | * | 10/1997 | Santilli | 345/168 |
| 5,757,339 A | | 5/1998 | Williams et al. | 345/8 |
| 5,764,202 A | | 6/1998 | Welch et al. | 345/8 |
| 5,784,073 A | | 7/1998 | Yamazaki et al. | 345/511 |
| 5,815,126 A | | 9/1998 | Fan et al. | 345/8 |
| 5,903,395 A | | 5/1999 | Rallison et al. | 359/630 |
| 5,945,972 A | | 8/1999 | Okumura et al. | 345/98 |
| 5,969,710 A | * | 10/1999 | Doherty et al. | 345/693 |
| 5,986,640 A | | 11/1999 | Baldwin | 345/147 |
| 6,008,785 A | * | 12/1999 | Hewlett et al. | 345/85 |

(Continued)

FOREIGN PATENT DOCUMENTS

EP 0 631 271 A1 12/1994

(Continued)

OTHER PUBLICATIONS

PCT International Search Report, mailed Mar. 20, 2003, re PCT/US02/37685 filed Nov. 21, 2002. (Applicant's reference: 065571.0106.).

(Continued)

*Primary Examiner*—Alexander Eisen
*Assistant Examiner*—Kimnhung Nguyen
(74) *Attorney, Agent, or Firm*—Baker Botts L.L.P.

(57) ABSTRACT

According to one embodiment of the invention, a method for displaying N-bit color on a plurality of pixels on a monitor includes, for each pixel, receiving a value indicative of one of a plurality of possible values for the level of intensity desired to be displayed on the pixel. The value is representable by N binary bits including a least significant bit. During a given time frame, the method includes providing an on state for the pixel for a continuous fractional portion of the given time frame. The fractional portion is indicative of the received value. The given time frame includes a fixed portion followed by a variable portion. For any of the possible values for the level of intensity, the time at which the pixel is turned on during the fixed portion, if at all, is independent of the least significant bit.

38 Claims, 8 Drawing Sheets

U.S. PATENT DOCUMENTS

| | | | | |
|---|---|---|---|---|
| 6,034,653 | A | 3/2000 | Robertson et al. | 345/8 |
| 6,040,812 | A | 3/2000 | Lewis | 345/89 |
| 6,046,712 | A | 4/2000 | Beller | 345/8 |
| 6,140,983 | A | 10/2000 | Quanrud | 345/55 |
| 6,151,011 | A * | 11/2000 | Worley et al. | 345/692 |
| 6,201,521 | B1 * | 3/2001 | Doherty | 345/84 |
| 6,226,054 | B1 * | 5/2001 | Morgan et al. | 348/759 |
| 6,239,781 | B1 * | 5/2001 | Fujisawa | 345/691 |
| 6,243,072 | B1 * | 6/2001 | McKnight | 345/690 |
| 6,351,077 | B1 * | 2/2002 | Koyama | 315/169.3 |
| 6,396,508 | B1 * | 5/2002 | Noecker | 345/693 |
| 6,518,977 | B1 * | 2/2003 | Naka et al. | 345/690 |
| 6,741,227 | B2 * | 5/2004 | Naka et al. | 345/72 |

FOREIGN PATENT DOCUMENTS

| | | |
|---|---|---|
| JP | 09 212140 | 8/1997 |
| WO | 9607947 A1 | 3/1996 |
| WO | 97/04436 | 2/1997 |

OTHER PUBLICATIONS

International Search Report in International Application No. PCT/US 00/17164, dated Jun. 21, 2000, 7 pages.

* cited by examiner

TV STATION
CABLE COMPANY
DIGITAL SATELLITE COMPANY
COMMUNICATION NETWORK
40
PIXEL DRIVER
LOGIC
INTERNET
24
28
30
20
22
34
18
14
48
38
10
44

18
54
50
58

50
64
ANODE
LC
60
52
PIXEL MIRROR
STORAGE
56
68

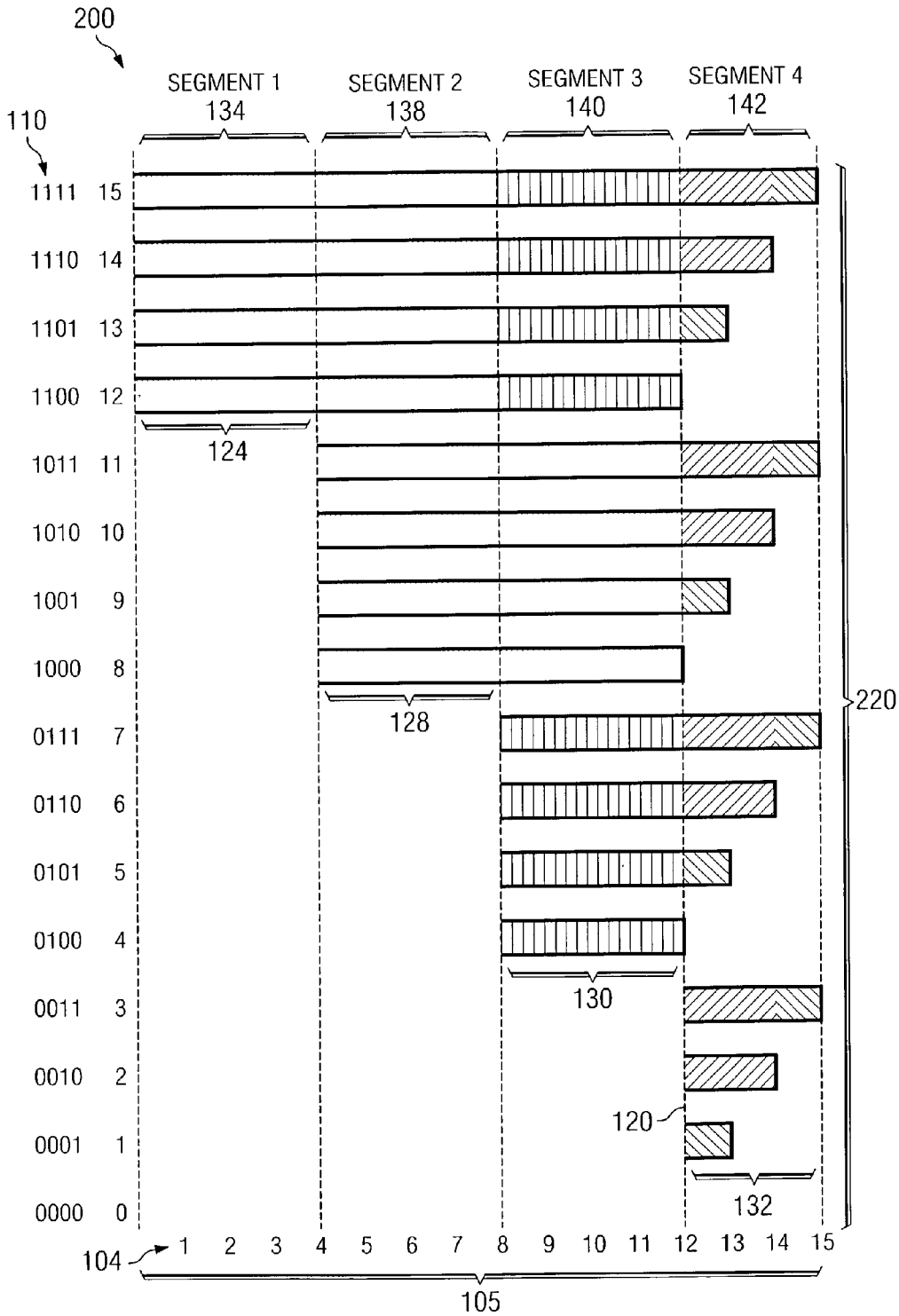
FIG. 2C
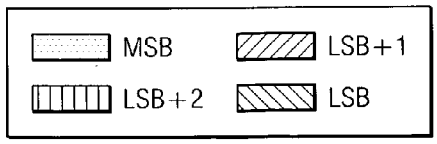

FIG. 3
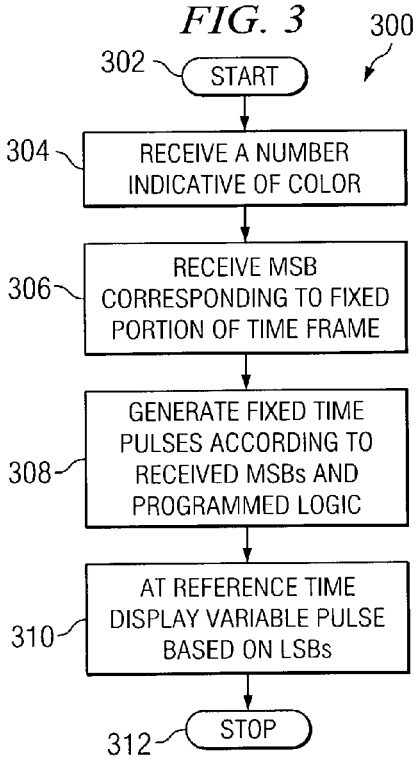
FIG. 4B
| 502/ 504 | TIME SEGMENT 1 | TIME SEGMENT 2 | TIME SEGMENT 3 |
|---|---|---|---|
| 1 1 | ON | ON | ON |
| 1 0 | OFF | ON | ON |
| 0 1 | OFF | OFF | ON |
| 0 0 | OFF | OFF | OFF |
534 536 538
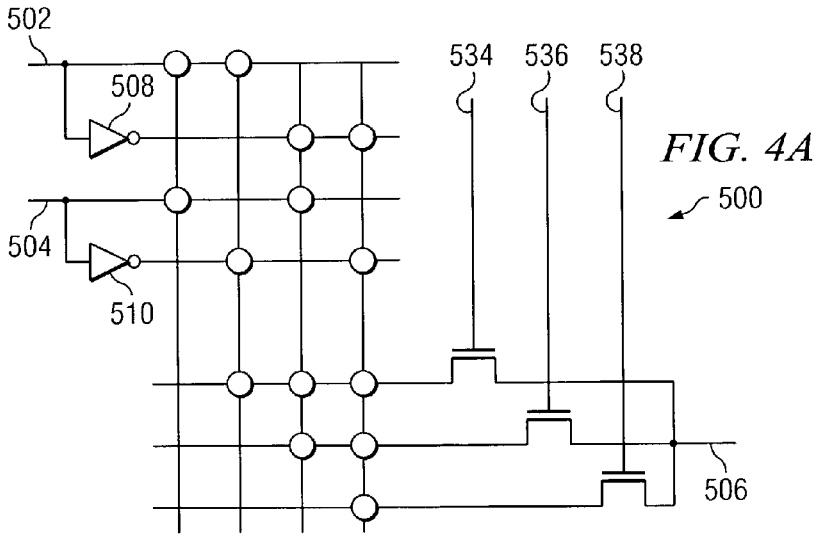
FIG. 4A

*FIG. 4D*
| 602/ 604/606 | TIME SEGMENT 1 | TIME SEGMENT 2 | TIME SEGMENT 3 | TIME SEGMENT 4 | TIME SEGMENT 5 | TIME SEGMENT 6 | TIME SEGMENT 7 |
|---|---|---|---|---|---|---|---|
| 1 1 1 | ON | ON | ON | ON | ON | ON | ON |
| 1 1 0 | OFF | ON | ON | ON | ON | ON | ON |
| 1 0 1 | OFF | OFF | ON | ON | ON | ON | ON |
| 1 0 0 | OFF | OFF | OFF | ON | ON | ON | ON |
| 0 1 1 | OFF | OFF | OFF | OFF | ON | ON | ON |
| 0 1 0 | OFF | OFF | OFF | OFF | OFF | ON | ON |
| 0 0 1 | OFF | OFF | OFF | OFF | OFF | OFF | ON |
| 0 0 0 | OFF | OFF | OFF | OFF | OFF | OFF | OFF |
*FIG. 5*
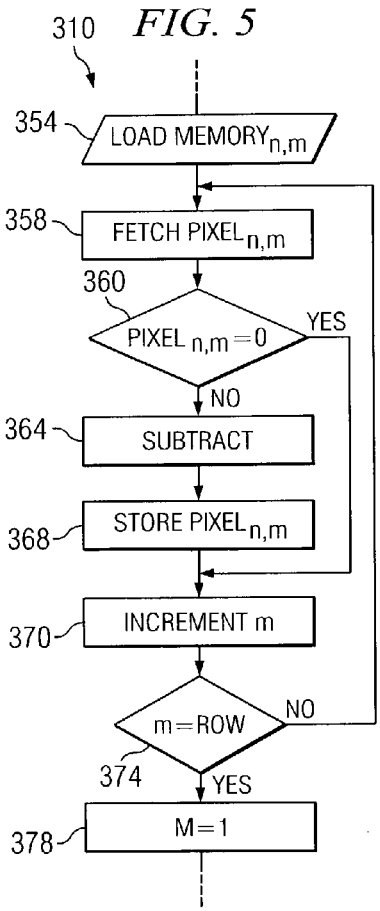
*FIG. 6*
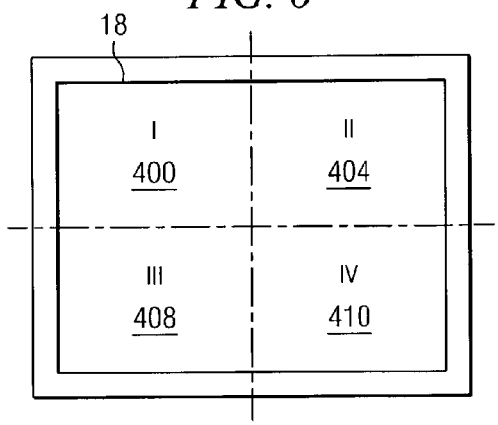

METHOD AND SYSTEM FOR DRIVING A PIXEL

RELATED APPLICATIONS

This application claims the benefit under 35 U.S.C. §119 (e) of the filing date of U.S. Provisional Application Ser. No. 60/331,956, filed Nov. 21, 2001 entitled Precision Pulse Technology, which is incorporated herein by reference.

TECHNICAL FIELD OF THE INVENTION

This invention relates generally to electronic systems and more specifically to a method and system for providing a single pulse for driving a pixel.

BACKGROUND OF THE INVENTION

Display units, such as a computer monitor or television, are commonly used to display an image. A display unit displays the image on a screen having rows and columns of pixels. After receiving signals indicating information concerning an image, a logic unit of the display unit excites the pixels according to the image information to recreate the image. The process of exciting the pixels is also referred to as "driving" the pixels.

Most conventional display units use analog signals to drive the pixels. For example, a particular color shade may be displayed using a signal having a particular level of voltage to drive a pixel. The voltage level used is indicative of the color or shade of gray intended to be represented. However, the range of voltage levels for an analog signal is narrow. Thus, analog signals may not be suitable for displaying numerous color shades because the voltage difference between the analog signals may become too small to accurately display an image.

To generate a more realistic image, digital signals may be used to drive pixels. During a given time frame, a pixel is excited by one or more pulses, with the fraction of the time frame in which the pixel is excited being indicative of the color or shade of gray to be displayed. However, pixels of some display units may not be digitally driven because some binary numbers may initiate pulses that are spaced apart, causing image errors. For example, pixels of a liquid crystal display unit may be difficult to drive with digital signals because the time period required by liquid crystal to assume a relaxed state after an excitation is longer than the time periods that separate the pulses. Thus, if the liquid crystal is excited by a pulse before completely relaxing from an excitation by a previous pulse associated, the actual brightness of the pixel may be brighter than the actual color shade intended to be represented.

SUMMARY OF THE INVENTION

According to one embodiment of the invention, a method for displaying N-bit color on a plurality of pixels on a monitor includes, for each pixel, receiving a value indicative of one of a plurality of possible values for the level of intensity desired to be displayed on the pixel. The value is representable by N binary bits including a least significant bit. During a given time frame, the method includes providing an on state for the pixel for a continuous fractional portion of the given time frame. The fractional portion is indicative of the received value. The given time frame includes a fixed portion followed by a variable portion. For any of the possible values for the level of intensity, the time at which the pixel is turned on during the fixed portion, if at all, is independent of the least significant bit.

Some embodiments of the invention provide numerous technical advantages. Other embodiments may realize some, none, or all of these advantages. For example, according to one embodiment, the brightness of a pixel may be adjusted by digitally modulating a pulse width. According to another embodiment, a plurality of pixels may be digitally driven without using a counter or a comparator for each pixel. According to another embodiment, a pixel of visual display units, such as a liquid crystal display unit, may be digitally driven by providing a continuous pulse for each binary number that indicates a particular brightness for the pixel.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which:

FIG. 2C is a timing diagram according to the teachings of the invention illustrating a plurality of continuous pulses used to drive pixels, such as the pixels of FIG. 1C;

FIG. 3 is a flowchart showing a method for generating pulses for driving a pixel according to the teachings of the invention;

FIG. 4A is a logic diagram and FIG. 4B is a corresponding logic chart illustrating one example of logic that may be utilized in creating the fixed timing pulses of FIG. 2C;

FIG. 4C is a second example of a logic diagram and FIG. 4D is a second example of a corresponding logic chart illustrating a second example of logic that may be utilized in creating the fixed timing pulses according to the teachings of the invention;

FIG. 5 is a flowchart illustrating the determination of a variable time pulse;

FIG. 6 is a block diagram illustrating a plurality of sectors of a display screen that may be used with some embodiments of the invention.

DETAILED DESCRIPTION OF EXAMPLE EMBODIMENTS OF THE INVENTION

Embodiments of the invention are best understood by referring to FIGS. 1A through 7 of the drawings, like numerals being used for like and corresponding parts of the various drawings.

Figure 1A:
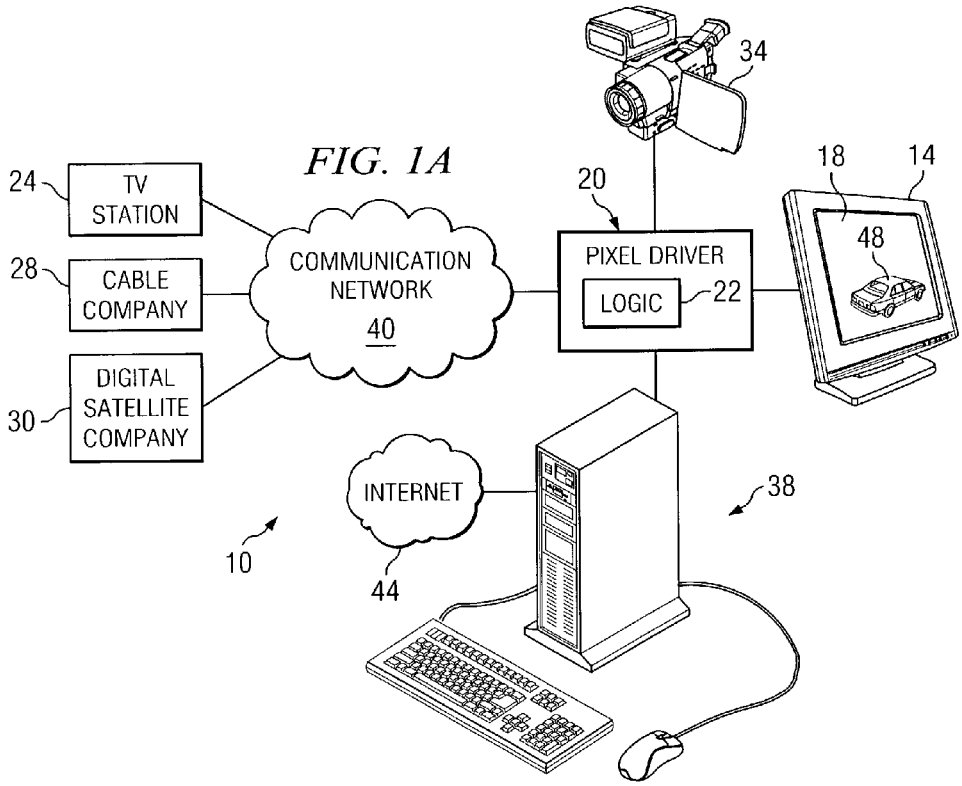
FIG. 1A illustrates a display system that may benefit from the teachings of the present invention.
Figure 1B:
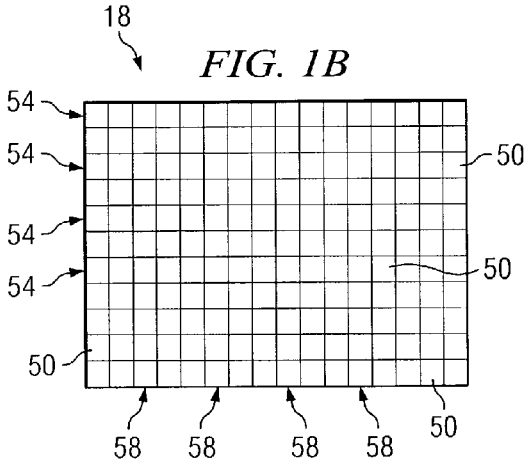
FIG. 1B is a schematic diagram illustrating one embodiment of a display screen shown in FIG. 1A.
Figure 1C:
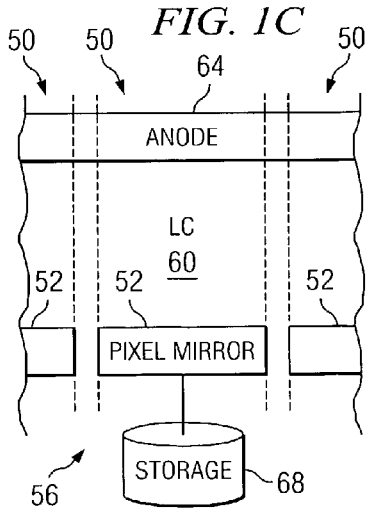
FIG. 1C is a schematic diagram illustrating a pixel shown in FIG. 1B.

FIG. 1A illustrates a display system 10 that may benefit from the teachings of the present invention. FIGS. 1B and 1C illustrate additional details of a display unit 14 shown in FIG. 1A. FIGS. 1A, 1B, and 1C are described jointly. Referring to FIG. 1A, display system 10 comprises display unit 14 having a display screen 18, a pixel driver 20 having a logic unit 22, and one or more image information sources coupled to the display screen through various communications conduits. Examples of image information sources shown in FIG. 1A include a television ("TV") station 24, a cable company 28, a digital satellite service ("DSS") company 30, a camera 34, and a computer system 38; however, any source of image information may provide image information to display unit 14 so that an image 48 may be displayed on screen 18 according to the image information.

TV station 24, cable company 28, and DSS company 30 may be operable to transmit image information to pixel driver 20 over a communications network 40. Image information may comprise information concerning the brightness, color, and/or shape of an image. Image information may indicate scenes from TV programs, movies, news, or sporting events, for example. Communications network 40 may be any information conduit or a combination of information conduits. Examples of information conduit include a wire network, wireless network, cable network, and fiber optic network. Any structure or method suitable for carrying digital and/or analog signals may be a part of communications network 40. Camera 34 may capture the image of an object, convert the image into image information, and transmit the image information to pixel driver 20. Image information from TV station 24, cable company 28, and DSS company 30 may have been obtained using cameras, such as camera 34. Computer system 38 may transmit image information stored in its memory and/or downloaded from internet 44 to pixel driver 20. Regardless of the source of image information, the image information is transmitted to pixel driver 20 in order to display image 48 according to the image information. Where a plurality of images 48 are displayed one after another by display unit 14, as is often the case with movies and TV programs, pixel driver 20 receives a virtually constant stream of image information and displays the indicated image 48 using display screen 18.

Pixel driver 20 is a device operable to receive image information and drive the pixels using logic unit 22. Logic unit 22 converts the received image information into a plurality of corresponding signals indicating various brightness levels and transmits the signals to each pixel of screen 18. Depending on the particular design of pixel driver 20 and display screen 18, the signals indicating the various brightness levels may be either analog or digital. Pixel driver 20 is shown as a component that is separate from display unit 14 for illustrative purposes. However, in most cases, pixel driver 20 is an internal component of display unit 14 and the image information received by pixel driver 20 may be initially received and processed by other components of display unit 14 before reaching pixel driver 20. Depending on the particular design of display unit 14, pixel driver 20 may be implemented as a single component or multiple components.

Display unit 14 may be any device operable to display an image, such as image 48. Examples of display unit 14 include a computer monitor, a regular TV set, and a high definition TV set. Screen 18 may be any suitable type, such as a wide screen, flat screen, plasma screen, cathode ray tube ("CRT") screen, liquid crystal ("LC") screen, digital mirror device ("DMD") screen, or other suitable types of screens. Referring to FIG. 1B, screen 18 comprises a plurality of pixels 50 that are arranged in rows 54 and columns 58. Each pixel 50 is operable to respond to a signal from pixel driver 20 by displaying a representation of a particular shade of color.

Referring to FIG. 1C, one embodiment of a structure 56 for displaying pixel 50 is shown. For illustrative purposes, structure 56 shown in FIG. 1C is a type used for a liquid crystal display ("LCD"); however, depending on the type of display that is used, such as DMD, structure 56 may be comprise different components to display pixel 50. Further, the teachings of the invention are applicable to any suitable form of display, including transmissive, polymer, and plasma types. Structure 56 comprises a liquid crystal layer 60 that overlies a pixel mirror 52, which may be formed from a complementary metal oxide semiconductor ("CMOS") having a mirror surface, or found through other suitable techniques. In some cases, structure 56 may comprise the drive electronics, such as logic unit 22. A glass anode layer 64 overlies liquid crystal layer 60. Pixel mirror 52 may be coupled to a memory device 68 for storing portions of image information.

Referring again to FIGS. 1B and 1C, in one embodiment, a memory bit, such memory 68, may be located at each pixel location and in the periphery of logic chip 22. Memory 68 may serve as a data storage for the column CPU. A row controller dispatches the operations to the column CPU including fetching the data for the column CPU and storing the results in the chip memory. The architecture has a flexible memory organization at the pixels and across the array.

Conventionally, display units fall into one of three categories; transmissive, reflective and emissive. The dominant display technology is emissive, an example of which is CRT. Newer technologies include flat panel transmissive liquid crystal displays which are used with most portable products and are currently replacing CRTs in non-portable applications such as desktop computer monitors and TVs. Plasma display technology is the leading flat panel emitting technology with organic light emitting diodes ("OLED")entering high volume production. Plasma technology traditionally involves emissive displays and utilizes a high voltage to excite a gas and react it with phosphors to produce an image. OLED utilizes lower voltages from about 12 to 20 volts.

Reflective technologies may be characterized as mechanical devices or liquid crystal devices. Mechanical devices, such as a digital mirror display ("DMD"), modulate the light by changing the direction of the reflective mirror surface directing the light at the target image or reflecting the light away from the target. A reflective liquid crystal device often uses a CMOS substrate with a mirrored surface upon which the liquid crystal is sandwiched between the mirrored surface of the CMOS and glass anode. An example of such a device is shown in FIG. 1C. Analog drive technology is used for the vast majority of displays, such as the CRT, LCD, OLED, and others.

As described above, a flat panel display screen, an example of which is shown as screen 18 of FIG. 1B, may be organized in columns 58 and rows 54 with pixels 50 located at the intersection of each row 54 and column 58. A panel display, such as a XGA display, may comprise 1024 columns and 768 rows selecting and controlling 786,432 pixels; however, the teachings of the invention may be applied to any desired number of pixels. A typical operation is raster scan, which is defined as sequencing through an array 54 or 58 from left to right and top to bottom one row at a time. Electronic data is written into each pixel as rows and columns are scanned and a composite image presented to the viewer. A conventional pixel electronic circuit may have a three-terminal transistor with the input connected to the column and the output connected to the pixel with the control connected to the row. The row is selected and the column data is transferred to the pixel.

Similar pixel operation occurs with the reflective LCD where the CMOS substrate embodies the pixel control electronics and the reflective pixel surfaces are set on top the CMOS electronics. A field between the CMOS and the glass anode rotate the light striking the surface and reflects a rotated light ray.

Referring back to FIG. 1A, in operation, image information is sent to pixel driver 20 from TV station 24, cable company 28, DSS company 30, camera 34, and/or computer system 38. Regardless of the source of image information, pixel driver 20 receives the image information and converts the image information, using logic unit 22, to analog or digital signals that excite a particular pixel. Once excited, the pixel displays a color of particular shade according to the signals from pixel driver 22. Because most image information comprises multiple images, multiple signals are generally transmitted to each pixel 50 of screen 18. This requires each pixel 50 to rapidly respond to each signal from pixel driver 22.

There are two fundamental pixel drive schemes used for displaying digital images stored on a Digital Versatile Disk ("DVD"), computer, digital TV or other electronic image sources. Analog or amplitude modulation converts a pixel's binary color value to an instantaneous voltage amplitude. The voltage amplitude in turn controls the degree of light transmitted, emitted or reflected from the pixel. The alternative is digital time division commonly referred to as Pulse Width Modulation ("PWM"), which converts a digital pixel value into a time based pulse where the width of the pulse in units of time controls the pixel's on and off time. The fraction of the time a pulse is on or off is indicative of the color to be represented.

Analog, or amplitude modulation, has its shortcomings. Analog, or amplitude modulation, uses a voltage representation for a digital value. For example, a 4-bit digital value is represented by 16 discrete voltage levels where $0000_2$ ($0_{10}$) has the pixel off or blocking the transmission or reflection of light through the polarizer. $1111_2$ ($15_{10}$) has the pixel full on to reflect or transmit maximum light representing full brightness. Assuming zero volts represents black and 5 volts represents white, the step between each gray level is 0.3125 volts. Current display products advertise 8-bits of color or intensity that would be represented by 256 discrete voltage values with each step 0.0195 volts for a 5-volt display.

Image transmission of the amplitude-modulated data is often inside an envelope with synchronization data identifying the beginning of a row and the pixel rate. Timing circuitry addresses the display rows and transfers the appropriate pixel voltage value to the corresponding pixel. Some of these methods depend heavily on timing accuracy. An analog voltage often must be sampled and transferred to the corresponding pixel in less than 21.2 nanoseconds for XGA resolution displays. A calculation of pixel time is shown below, Pixel Rate=rows*columns*fps Pixel rate=768*1024*60=47,185,020 pixels per second Pixel time=1/pixel rate=21.2 nanoseconds A pixel voltage value generally should remain constant during the transfer from the column input to the pixel transistor output. Any noise in the column circuitry is often transferred to the pixel introducing color errors.

Analog displays often deal with very small variances in signal levels. A five-volt liquid crystal operation requires the pixel circuit to control the applied voltage to plus or minus 0.0097 (½ LSB) volts for values from zero to five volts. For example, a color value of 142 requires 2.7734 volts across the liquid crystal pixel in order to achieve accurate light output. Signal variances greater than plus or minus 0.0097 result in a color value in the range of 141 to 143. In order to achieve an accurate color at the pixel, the display circuitry must transfer the input $\text{voltage}_{n,m}$ to $\text{pixel}_{n,m}$ with virtually no loss or distortion due to noise and timing variances.

Additional problems with analog display recognized by the teachings of the invention include high development costs for an analog display, which may be three to four times that of a digital display. Further, the development of an analog display may take at least twice the time as that needed for a digital display. Manufacturing costs may be four to five times higher than a digital display due to tight tolerances and the lack of redundancy for signal pixel failures.

Digital drive is considered to be much more difficult to design when compared to analog design due to the complex circuits required to convert a binary number to a pulse width and the problems involved with controlling hundreds of thousands of pulses simultaneously. An 8-bit pulse width generator for converting an 8-bit per pixel color value into a time domain pulse for XGA (1024×768 pixel array) display is generally not believed feasible with the currently existing technology. Various pseudo-PWM techniques have been developed to reduce the pixel control from a PWM generator to a few bits of memory. These pseudo-PWM techniques often either introduce image artifacts and/or create problems with input/output ("I/O") bandwidth where the data transfer to the display is a function of the least significant bit ("LSB") display time. For the above example, the data rate required would be:

Data Rate=fps*color-bits*columns*rows fps=field per second=60 bits=bits per color=8 columns=1024 rows=768

Data Rate=60*256*1024*768=12,079,595,520 bits per sec.

It is difficult to design an I/O interface to run at 12 gigabits per second using the technology required for certain screen types, such as the liquid crystal. Liquid crystal currently requires three volts or more to operate, which generally requires a 0.25-micron CMOS technology or 0.35 CMOS micron technology. The state of the art design using 0.18 microns delivers 2.5 gigabits, roughly one-fifth the 12 gigabits. A challenging design for 0.25 micron technology is 100 megabits per second which translates into an I/O interface with 120 data pins plus power, ground, control and clocks. High pin count I/O is also a significant design challenge to overcome because of the need to maintain signal integrity while minimizing emissions. In short, PWM is difficult.

According to the teachings of the invention a special form of the digital drive approach is utilized to display pixels that result in a plurality of continuous pulses, which as described in greater detail below, addresses disadvantages of some prior systems.

Figure 2A:
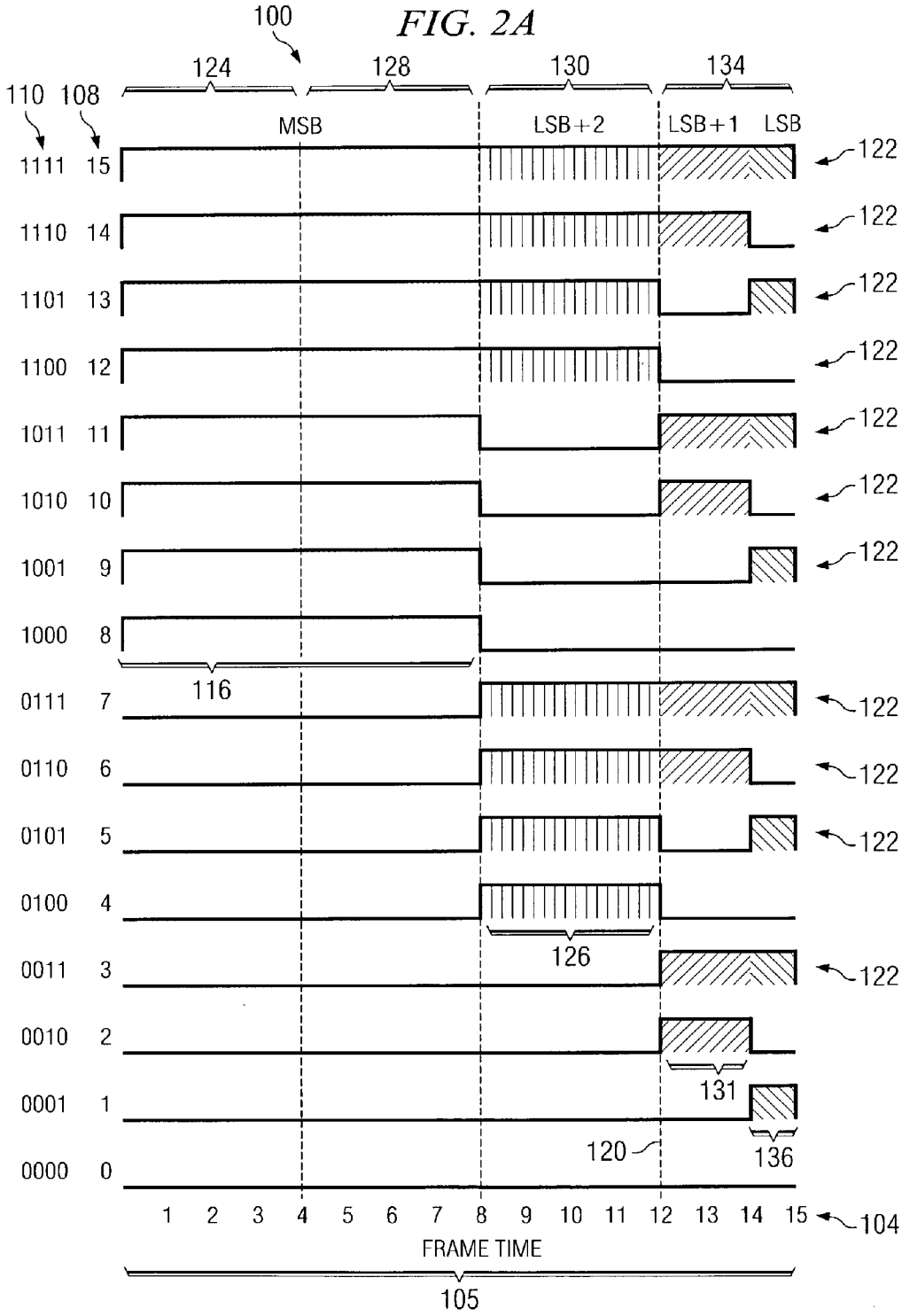
FIG. 2A is a conventional timing diagram illustrating pulses used to drive pixels.

FIG. 2A is a conventional timing diagram 100 for a 4-bit color scheme used in a conventional digital drive approach. A horizontal axis 104 shows a single frame time 105 divided into equal units ("0" to "15"). A vertical axis 108 shows 4-bit binary numbers 110 representative of the color of a pixel arranged from "0000" (darkest) to "1111" (lightest). In general, driving pixels according to this timing diagram involves receiving a value indicative of a color in binary form, and then turning a corresponding pixel on or off for time periods corresponding to each bit of the received binary number. For example, for binary number "0000" (darkest), each bit is off (zero volts) and no pulse is initiated for the frame period of, in this example, 16.667 milliseconds. A binary value "1111" shows all bits at, in this example, 5-volts for the 16.667 milliseconds and the pixel would be a maximum brightness for the frame.

In this sense, the most significant bit of binary number 110 corresponds to about the first eight-fifteenths of time frame 105, the second MSB corresponds to the time from about eight-fifteenths through time frame 105 to about twelve-fifteenths of the way through time frame 105, the next bit corresponds to about twelve-fifteenths of the time through about fourteen-fifteenths of the time frame 105, and the least significant bit corresponds to about the one-fifteenth of time frame 105. Generally, utilizing this approach, the fraction of time frame 105 of any bit within number 110, or bit length, is defined by about $2^n/[2^{1-1}]$, where n is the bit location where the LSB is position zero and the MSB is in location i−1 and i is the number of bits of gray scale (or color), e.g., in this example the bit number of the MSB is three and the bit number of the least significant bit is zero. For example, the value 13, or binary 1101, is represented as follows: During the first half of time frame 105 the pixel is turned on, corresponding to a MSB value of one; then the pixel remains on, corresponding to a LSB+2 of one; then at twelve-fifteenths of the way through time frame 105 the pixel is turned off, corresponding to a LSB+1 of zero; then at fourteen-fifteenths of the way through time frame 105 the pixel is turned on, corresponding to a least significant bit of one. Thus the total duration of the time the pixel is on is equal to (13/15)×100 percent of the time, and the particular times at which the pixel is turned on are illustrated in FIG. 2A as being off for between twelve-fifteenths and fourteen-fifteenths of time frame 105 and being on for the remainder of the time frame. Each series of turning on and off the pixel corresponding to a particular binary number 110 is designated as a pulse 122. The sequence of the pixels integrated over the frame period by the viewers' eye yields either color or gray scales from black to white. This drive technique is referred to herein as a "pulse position technique."

For each binary number 110 having more than one pulse, a particular chain 122 of pulses is formed. Some chains essentially form a continuous pulse because no time space exists between pulses. For example, pulse chain 122 associated with binary number "1100" may be considered a continuous pulse. However, pulse chain 122 associated with binary number "1010" may be considered a non-continuous pulse.

As shown in the 4-bit color scheme timing diagram 100 of FIG. 2A, the time period in which control of a pixel depends on the LSB becomes extremely small. For an 8-bit color display running at 60 frames per second, a time slot corresponding to the LSB would be approximately 65 microseconds. This implies that the display pixels must switch in a few tens of microseconds in order to respond to the LSB. Pulse position drive may work satisfactorily for some DMD applications due to DMD's fast switching time of ten microseconds or less. However, certain features added to the DMD to overcome its inherent disadvantages, such as adding white segments to solve the brightness problem of DMD, reduces the actual time slot for an LSB pulse to a level that may exceed the capabilities of DMD. This may cause image errors, such as the flickering of pixels. Unlike DMD, a liquid crystal display switches in two to three milliseconds, which is 30 times longer than the time slot for an LSB pulse. This is problematic for the digital drive. Thus, liquid crystal displays may not be capable of switching fast enough to timely initiate a LSB pulse.

Another disadvantage with the digital pulse position drive of FIG. 2A recognized by the teachings of the invention is the non-monotonic intensity arising from this approach. Monotonic intensity refers to having increased brightness with increased pixel values. Once driven to an excited state, LC materials naturally relax to a relaxed state. However, the rate of energy drain during the relaxation of the LC material is lower than the rate at which the energy is introduced to the LC material to drive the material to its excited state. Stated in other words, the energy lingers as the LC material relaxes to its relaxed state. Thus, when a pulse is applied before the LC material completely assumes its relaxed state, the energy of the applied pulse is added with the residual energy, resulting in a brightness level that is higher than the level indicated by the binary number. For example, referring to FIG. 2A, the light intensity associated with binary number "1100" having a value of "12" on vertical axis 108 should be higher than that associated with binary number "1010" having a value of "10" on vertical axis 108. However, the resulting intensity associated with value "12" actually may be lower than that of value "10," which indicates non-monotonic intensity.

The teachings of the invention recognize that a reason for this is because binary number "1010" is associated with a non-continuous chain 122 of pulses. As described above, as pulses are turned on and turned off, there is a time delay before which the actual value desired is attained. For example, with respect to pixel display corresponding to "1010", before the liquid crystal display is allowed to assume a completely relaxed state from the excitation during the first half of the time frame 105, excitation of the pixel corresponding to the LSB+1 excites the liquid crystal display again, which may result in a brightness that is higher than the one actually represented by "1010" because the brightness accounts for both excitation corresponding to the LSB+1 and the residual energy from the previous excitation corresponding to the MSB. Thus, the actual brightness resulting from "1010" may be higher than the actual brightness resulting from "1100" due to device limitations even though the value of "1010"is lower than the value of "1100."

In addition to non-monotonic intensity, the teachings of the invention recognize that some pulse position drive LCs create image artifacts that may be classified as a dislocation. The visible results of the "dislocation" are fine lines in the image resembling a noisy CRT TV image. Referring again to FIG. 1C, some LCDs may be designed to have a voltage applied between two parallel plates, such as anode 64 and pixel mirror 52, which creates an electric field. The electric field in turn twists the LC molecules along the field and changes the polarization of the light passing through liquid crystal layer 60. In some instances, digital drive may drive pixels 50 such that adjacent pixels 50 are at different logic levels. This means the field between pixel mirrors 52 may be greater than the field between pixel mirrors 52 and anode 64. In one example, the space between anode 64 and pixel mirror 52 may be three microns or greater and the gap between pixel mirrors 52 may be 0.6 microns. In such instances, the lateral field between pixel mirrors 52 may be six times the field strength between pixel mirror 52 and anode 64. This lateral field titles the LC molecule and produces an apparent LC dislocation (similar to a void), which is observed by the viewer as a white line in a gray background.

Referring back to the timing diagram of FIG. 2A, an example of dislocation occurs between a pixel with value of 11 and its neighbor with a value of 12 (shown as values "11" and "12" on vertical axis 108). Between about 8/15 and 12/15 of the way through the time frame, a pixel mirror with a value of 11 is off (zero volts) when a pixel with a value of 12 is on (five volts). During the remainder of the frame the reverse occurs, which produces the white line when a gray field is displayed. The length of the line and brightness is proportional to the time the pixels are at alternate values. This becomes apparent when considering the time it takes to switch a pixel from off to on.

Figure 2B:
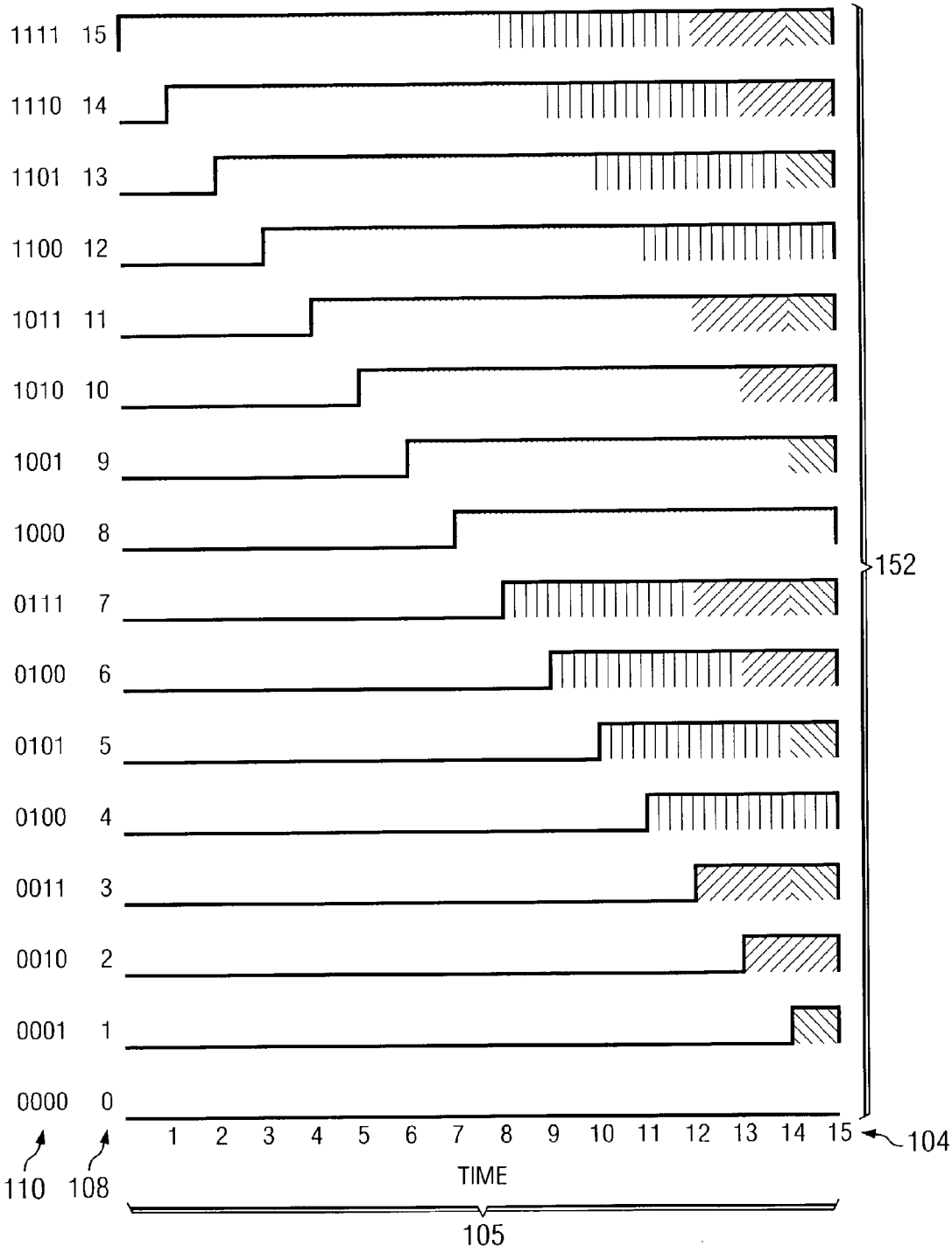
FIG. 2B is a timing diagram illustrating desirable pulses for driving pixels but that suffers from implementation difficulties.

The teachings of the invention recognize that some of the disadvantages described above may be substantially reduced by driving pixels 50 using pulse width modulation ("PWM"). As used herein, PWM refers to providing a single pulse (or a continuous chain of pulses) to represent each particular color, rather than a series of discontinuous pulses. Such an approach is illustrated in FIG. 2B, in which a pixel is turned on at a time within time frame 105 corresponding to the color value, or numbers 110, 108, and left on for the remainder of the time frame 105. PWM may be extremely difficult to implement with currently available technology. For example, one implementation of an array with 786,432 pixels and 255 unique color values would likely require an 8-bit counter or comparator at each pixel location. An 8-bit value stored in a counter at each pixel with the counter subtracting one each LSB time period and the output of the counter attached to the pixel electrode would produce a single pulse with a duration proportional to the binary value initially stored in the counter.

Although driving pixels 50 using a single pulse is desirable, the technology likely required to drive the liquid crystal to 3.3 volts or 5.0 volts would likely preclude using 0.20 micron or more advanced technology that would allow the engineer to implement a full PWM per pixel, as illustrated in FIG. 2B.

According to one embodiment of the present invention, a method and system are provided that allow pixels to be digitally driven using single pulses by creating continuous pulse chains. This is advantageous in some embodiments of the invention because display units may benefit from PWM without using a comparator or counter in each pixel, although such comparators or counters may also be used. In another embodiment, monotonic intensity may be attained for pixels that are digitally driven. In another embodiment, images that are brighter and free of errors may be displayed by driving each pixel using a continuous pulse. In another embodiment, a pixel of visual display units, such as a liquid crystal display unit, may be digitally driven by providing a continuous pulse for each binary number that indicates a particular brightness for the pixel. Additional details of example embodiments of the invention are described in greater detail below.

In general, in response to receiving any number representing a color or shade of gray, logic unit 22 generates fixed time pulses ("FTPs") corresponding to the bits preceding a reference time 120 (FIG. 2C) to represent the most significant bits of the value to be represented. This is performed in order to generate a continuous pulse that extends to reference time 120. Logic unit 22 is further operable to initiate, at the reference time, a pulse equal in duration to a value representative of the less significant bits of the number. This pulse is referred to as a "variable time pulse" or "VTP." By ending a continuous chain of FTPs at the reference time and starting a VTP at the reference time, a continuous pulse is formed to drive each pixel, which as described below is desirable. An example of an integrated circuit that may be used to implement logic unit 22 is DISPLAY DIGITAL SIGNAL PROCESSOR ("DDSP"), available from Silicon Display Incorporated.

FIG. 2C is a timing diagram 200 illustrating the timing of pulses according to the teachings of the invention that results in a plurality of continuous pulses 220 associated with each binary number 110. A chain 210 comprising a plurality of fixed time pulses (FTPs) 124, 128, and 130 and variable time pulses VTP 132 are joined at a reference time 120 to form continuous pulses 220. The portion of frame 105 preceding reference time 120 is referred to as the fixed portion and the time period after reference time 120 is referred to as the variable portion. Each continuous pulse 220 has the same total duration as the sum of corresponding pulses from the pulse position technique (shown in FIG. 2A) and the PWM technique of FIG. 2B. Some continuous pulses 220 do not have a FTP component or VTP component. This is because these binary numbers do not utilize a component before or after reference time 120.

The teachings of the invention recognize that the desirable continuous pulses, such as those illustrated for a four-bit color example in FIG. 2B, may not be effectively implemented without requiring new decisions or changes of the excitation state of a pixel during every time division of frame 105 (times zero to fifteen in FIG. 2B). Rather, the teachings of the invention recognize that pulses 122 of FIG. 2A, or pulses 152 of FIG. 2B, can be arranged in time within time frame 105, as illustrated in FIG. 2C, such that decisions on whether the corresponding pixels should be turned on or off, or actual changes of state of the pixel, can be made at a limited number of discrete times within time frame 105. In this particular example, either decisions on whether a particular pixel should be turned on or off, or the changes themselves, only have to be made at approximately times segment intervals 134, 138, and 140 corresponding to four-fifteenths, eight-fifteenths, and twelve-fifteenths of the way through time frame 105, or the fixed time pulses portion of frame 105, and the more difficult-to-implement time changes associated with the lesser significant bits are made solely within the last portion of time frame 105, time segment 142, or the variable portion of time frame 105. By splitting the desired pulses in this manner, simple logic may be used during most of the time frame 105, corresponding to time segments 134, 138, and 140, with a limited number of counters required for display associated with the least significant bits in time segment 142.

The above example involved display of pixels according to four bits of data; however, the teachings of the invention are applicable to any suitable number of bits. The division of pulses 220 into fixed pulses and variable pulses, as described above may occur in suitable manners determined by the implementation constraints. Two example implementations involving eight bit and ten bit color schemes are described in greater detail below. However, in one embodiment, time slots for the LSB and the LSB+1 may be modified to reflect the specification of the liquid crystal material used in the micro-display. Slow materials may require a longer LSB time slot than a faster liquid crystal. In one embodiment, the pulse width may be controlled to match the characteristics of the liquid crystal materials. It should be understood that for any given number of bits used to represent color or shades of gray, the selection of the number of these bits allocated to the fixed portion of time frame 105 and the number allocated to the variable portion of time frame 105 may vary depending on implementation. Additional details are described below in conjunction with FIGS. 3 through 7.

FIG. 3 is a flowchart showing a method 300 including general steps associated with one embodiment of the invention for displaying N-bit color that results in the use of continuous pulses that addresses some of the above-described disadvantages associated with prior systems and methods. In one embodiment, this method may be implemented, or initiated, by logic unit 22; however, other suitable implementations of such a method may be utilized.

The method begins at step 302. At step 304, a number indicative of a color or shade of gray is received. Such a number may be represented in binary form with a plurality of bits, including a most significant bit and a least significant bit. At a step 306 the most significant bits corresponding to the fixed portion of time frame 105 are received by a particular portion of, in this example logic unit 22. It should be understood that such receipt may also include receipt of the least significant bits; however, the value of the least significant bits are not relevant to calculations within the fixed portion of time frame 105. As described above, it should be understood that the number of the most significant bits devoted to the fixed portion of time frame 105 may vary depending upon implementation. For example, n one implementation in which five bits of storage are available for each pixel, those five bits are devoted to the variable time period and the remaining bits of a number are addressed in the fixed time period. Thus, 8-bit color has five variable and three fixed bits; 10-bit color has five variable and five fixed; and 12-bit color utilizes five variable and seven fixed.

At step 308, based on the received most significant bits and programmed logic (described in greater detail below), fixed time pulses for responding to the number received at 304 are generated for the fixed portion of time frame 105. At step 310 the least significant bits corresponding to the variable period of time frame 105 are displayed. Such display may involve conventional logic, such as that described above in conjunction with FIG. 2A. The display of the variable time portion begins at reference time 120 (FIG. 2C). The method concludes at step 312. Additional details associated with generating pulses for displaying N-bit color according to the teachings of the invention are described below in conjunction with FIGS. 4A–7.

FIGS. 4A–4D illustrate logic charts and tables that may be used for implementing the generation of fixed time pulses, such as 124, 128 and 130 according to the teachings of the invention. Logic according to the diagrams may be implemented with logic unit 22 of pixel driver 20.

FIG. 4A illustrates logic diagram 500 that may be used to implement generation of fixed time pulses 124, 128, and 130 according to the teachings of the invention. Logic diagram 500 includes nodes 502 and 504, which receive the most significant bit and the next most significant bit, respectively, of binary number 110 corresponding to a particular color to be displayed on a pixel. Logic diagram 500 includes inverter 508 and inverter 510 for providing the inverse of the inputs 502 and 504. Logic diagram 500 includes an output 506 corresponding to time segments 134, 138 and 140 of FIG. 2C. The output at 506 is switched between the various possible outputs by transistors 534, 536, and 538, corresponding to time segments 134, 138, and 140, respectively. The values resulting from logic diagram 500 are also illustrated in table 3B where the first column of the table represents the most significant bit and the next most significant bit. During the various time segments, the particular pixel is "on" depending upon the state of most significant bit and the next most significant bit of binary number 110, corresponding to a particular color to be displayed on a pixel, as shown in the table.

Logic for implementing the most significant bit pairs received by inputs 502 and 504 and the desired outputs 506 may be readily programmed in software or hardware according to conventional techniques, and may be implemented in logic unit 22. The above example is provided for example purposes only, and the invention is not limited to a four-bit color scheme, but rather may utilize any suitable number of bits to represent color or shades of gray on a pixel.

Figure 4C:
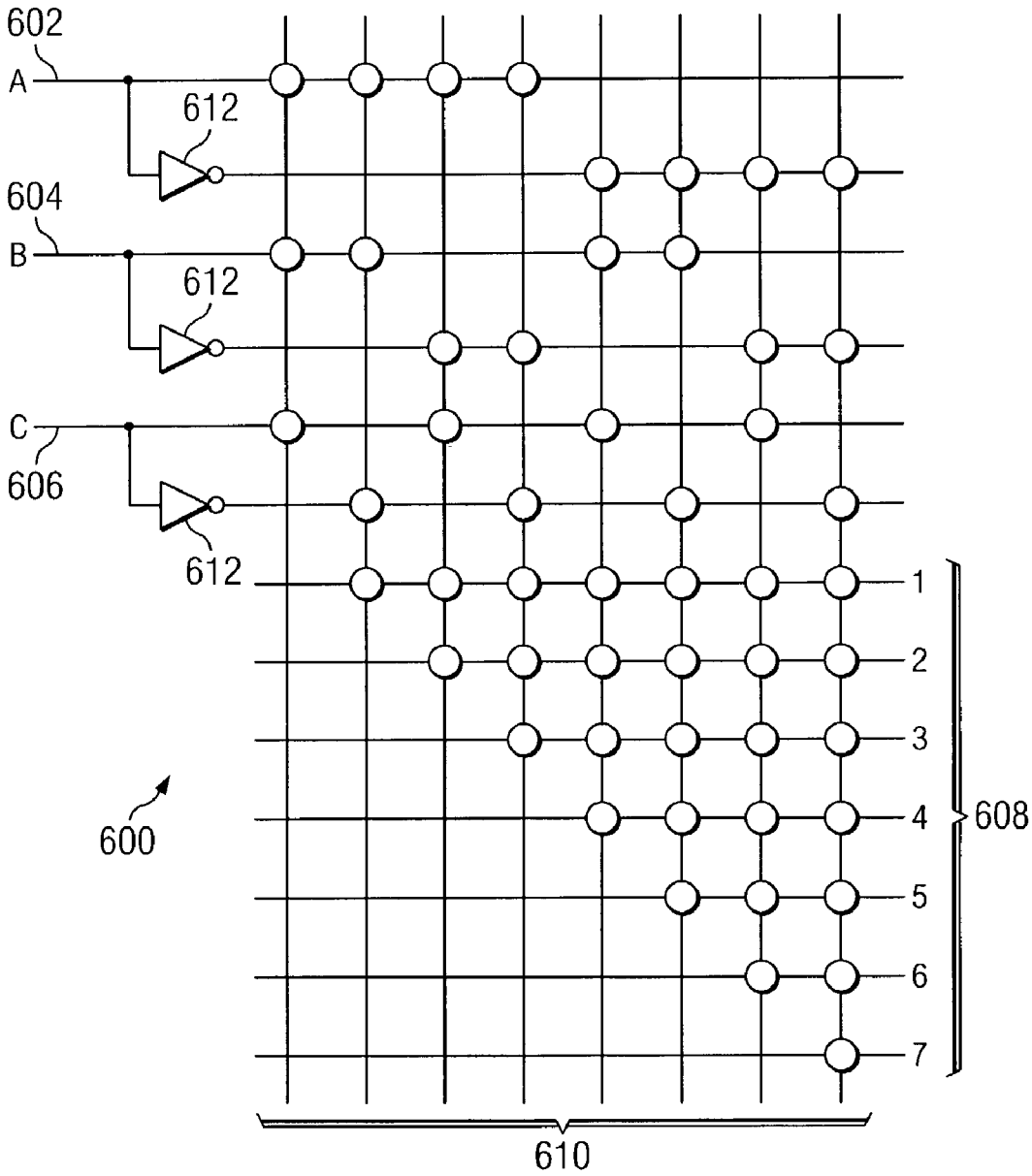

A second example is provided in FIGS. 4C and 4D for an eight-bit color configuration in which the three most significant bits are utilized for providing fixed time pulses and the five least significant bits are utilized for providing variable time pulses. It should be noted that although this division between fixed time pulses and variable time pulses is illustrated as an example, alternative choices for an eight bit color scheme may include four bits devoted to fixed time pulses and four bits devoted to variable time pulses, or other suitable divisions.

In FIG. 4C logic diagram 600 includes inputs 602, 604, and 606, corresponding to the most significant bit, the next most significant bit, and the second next most significant bit, respectively. Outputs 608 are provided for, in this example, seven time frames designated collectively by reference numeral 610. Logic diagram 600 includes three inverters 612 for logically complementing the inputs. The outputs 608 correspond to the values in the table of FIG. 4D for illustrating whether a particular portion of a pulse 220 is turned on or off during one of the designated segments of time frame 105.

FIG. 5 is a flowchart illustrating details of generating variable time pulse 132 according to one embodiment of the invention. At step 354, the least significant bits of binary number 110 for a particular pixel 50 corresponding to time segment 142 are loaded into memory, such as a memory unit within pixel driver 20 (not explicitly shown). In one embodiment, storing the LSB data includes setting a mirror latch to one for all none zero pixel values. At step 358, a pixel data, such as a binary number, is received. At decision step 360, logic unit 22 determines whether the binary number is a zero. If no, then at step 364, a +1 is subtracted from the pixel value and the resulting value returned to its source location in memory 68 at step 368. Concurrently with returning the resultant value to memory 68, the corresponding mirror latch is updated and if it was a one and the resultant is a one, the mirror latch does not change and if the latch was a one and the resultant value is a zero, the mirror latch will reset to zero. At step 370, +1 is added to m, incrementing the row location in memory 68. Referring back to decision step 360, if logic unit 22 determines that the value of binary number is equal to zero, then the "yes" branch is followed to step 370. Referring back to decision step 360, if logic unit 22 determines that the value of binary number is equal to zero, then the "yes" branch is followed to step 370. At decision step 374, logic unit 22 determines whether the row number m is out of range or exceeds the array by comparing m to the maximum Row value and for example purposes could be 768 as in a 1024 column by 768 row display. If yes, then logic unit 22 resets the row location to 1 at step 378. If no, then the "no" branch is followed back to step 358. In this manner, variable time pulse 132 may be generated. It should be understood that the above is simply one example of the generation of variable time pulse 132, which could be generated according to other techniques.

FIG. 6 is a schematic diagram illustrating one embodiment of screen 18 that is divided into a plurality of sectors 400, 404, 408, and 410 for performing time multiplexed processing in displaying pixels according to the teachings of the invention. Although screen 18 is divided into four sectors in FIG. 6 because a 4-bit color scheme is used as an example, screen 18 may be divided into any number of sectors depending on the type of color scheme used. For example, 8-bit color may utilize 16 screen sectors. Time multiplexed processing allows bandwidth savings for VTP calculation by calculating the VTP for only a portion of the pixels within the array during any time segment within time frame 105. In general, for the example where five bits are available for the variable time period, the display is divided into at least eight subarrays for 8-bit color, thirty-two subarrays for 10-bit color, and one hundred twenty-eight subarrays for 12-bit color.

In one embodiment, at a given time segment within a time frame, FTPs 124, 128, and 130 (FIG. 2C) are displayed in sectors 400, 404, and 410, respectively. Thus, at the beginning of a time frame, FTP 124 corresponding to segment 1 (FIG. 2C) is displayed in sector 404; FTP 128 corresponding to segment 2 is displayed in sector 404; and the FTP 140 corresponding to segment 3 is displayed in sector 408; and the VTP 132 is displayed in sector 4. After fixed time pulse 124, 128, and 130, and VTP 132 are displayed during the first time segment 134 of frame 105 in sectors 400, 404, 408, and 410, respectively, the pulses 124, 128, 130, and 132 rotate sectors at the next time division. For example, pulses 124, 128, and 130 are displayed in sectors 404, 408, and 410, respectively. Segment 132, which is the VTP, is calculated and displayed only for sector 400.

Logic unit 22 continues to rotate the display of each of the pulses 124, 128, 130, and 132 through sectors 400, 404, 408, and 410 for each binary number it receives, which allows logic unit 22 to perform VTP calculations for, in this example, one quarter of the pixels at a time. More importantly, bandwidth limitations might otherwise prevent access of the pixels in the time frame required for accurate resolution if it was attempted to update all pixels in the array at the same time. The fixed time pulses do not suffer this difficulty, so these bandwidth constraints may be overcome by time multiplexing and rotating calculation and loading of the VTP 132, as described above. It will be appreciated that, if rotation is employed, time frames 105 for each sector will appear to be somewhat shifted with respect to different sectors, but that the pulses 220 remain continuous. This is advantageous in some embodiments where memory space for each pixel 50 is limited. For example, a pixel of a flat panel screen having only one bit of memory available may rotate the display of pulse segments to avoid overloading the memory.

Figure 7:
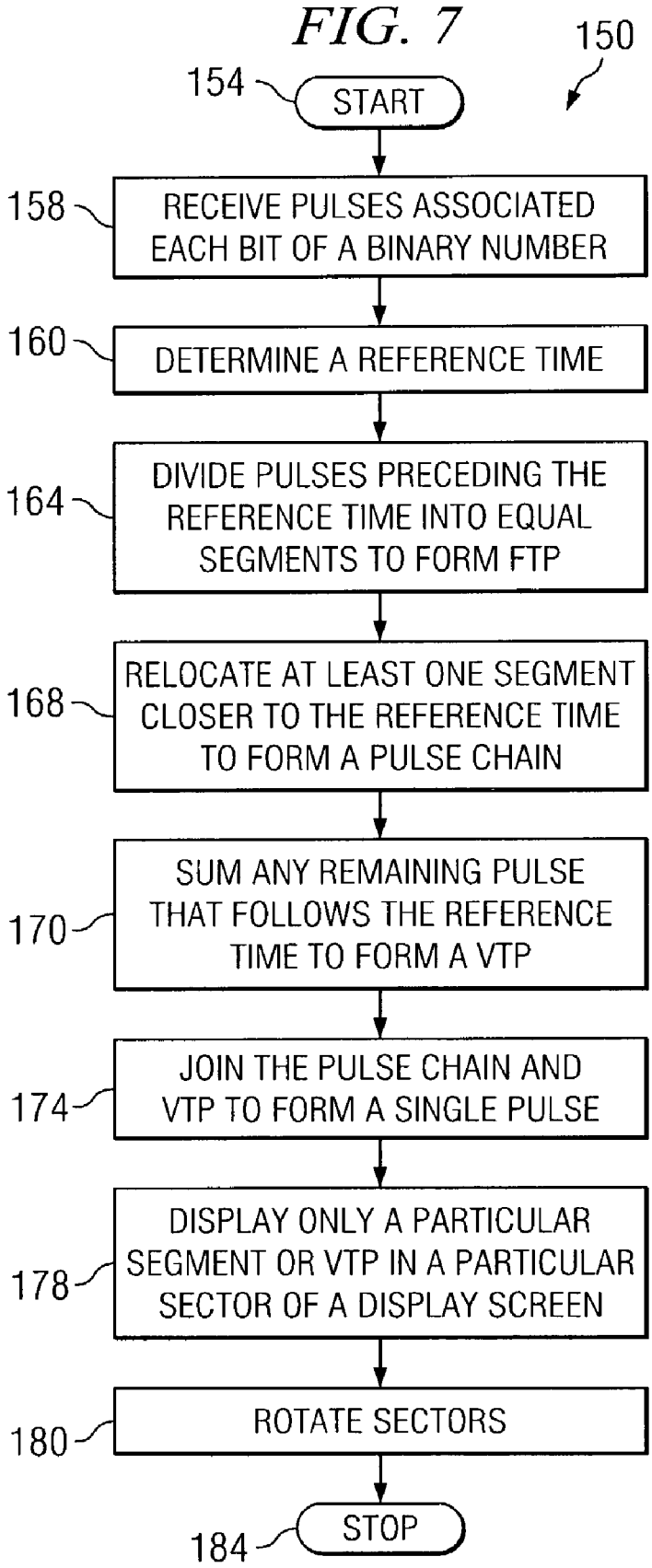
FIG. 7 is a flowchart illustrating determination of the form that the pulses according to the teachings of the invention should take.

FIG. 7 is a flowchart illustrating a method of generating pulses. To aid in the understanding of the teachings of the invention, a method 150 for generating pulses 220 of FIG. 2C is described with reference and comparison to conventional techniques involving pulses 122 of FIG. 2A. However, it will be recognized that the below-described steps are not necessary to generate pulses 220 according to the teachings of the invention.

Method 150 starts at step 154. At step 158, pulses 116, 126, 131, and/or 136 (FIG. 2A) that are associated with a particular binary number 110 are identified in terms of the frame time. For example, whereas binary number "1111" initiates one MSB pulse 116, one LSB+2 pulse 126, one LSB+1 pulse 131, and one LSB pulse 136, binary number "1011" initiates one MSB pulse 116, one LSB+1 pulse 131, and one LSB pulse 136. (no LSB+2 pulse 126, which creates a time gap).

At step 160, reference time 120 is determined for all binary numbers 110. For example, as shown in FIG. 2A, reference time 120 is graphically depicted by a dotted line at time "12," which is indicated on the horizontal axis 104. Reference time 120 may be selected depending on the particular design of screen 18 and the increment of pulses by which adjustments may be made to form a continuous pulse chain that ends at reference time 120. For example, for an 8-bit or 10-bit color scheme, the time when an LSB+5 pulse ends may be selected as reference time 120 because the size of the pulse associated with LSB+5 is a sufficient pulse increment by which pulses preceding a reference time may be adjusted to form a continuous chain of FTPs. Stated in other words, in one embodiment, the end time in which a pulse having a duration that may serve as an increment of adjustment to form the continuous chain of FTPs may be selected as reference time 120. Reference time 120 is selected at a time that is in the later half of the frame time, in some embodiments.

At step 164, in one embodiment, pulses preceding reference time 120 in FIG. 2A are divided to form FTPs. In the example shown in FIG. 2A, MSB pulse 116 associated with a binary number is divided in half to form segments 124 and 128 in FIG. 2C (also referred to as FTPs 124 and 128). Although the LSB+2 pulse 126 also precedes reference time 120, the LSB+2 pulse 126 is not divided into segments because the duration of the LSB+2 pulse 126 is already equal to those of segments 124 and 128. Thus, the LSB+2 pulse 126 is not divided and referred to in its entirety as a segment 130 or FTP 130. Pulse segments 124, 128, and 130 are equal in duration. Pulse segment 132, which is a VTP, may have a duration that is equal to or less than those of pulse segments 124, 128, and 130. Depending on the type of color schemes (8-bit, 10-bit, 12-bit, or 14-bit color schemes, for example), different pulses associated with the bits of binary numbers may be divided into different number of equal segments. For example, for an 8-bit or a 10-bit color scheme, pulse segments may be divided in the following manner, in some embodiments.

| 8-Bit Color | | | 10-Bit Color | | |
|---|---|---|---|---|---|
| Binary Bit | (seconds) | PPT (seconds) | Binary Bit | (seconds) | PPT (seconds) |
| 7 | 0.008333 | 0.002083 | 9 | 0.008333 | 0.002083 |
| | | 0.002083 | | | 0.002083 |
| | | 0.002083 | | | 0.002083 |
| | | 0.002083 | | | 0.002083 |
| 6 | 0.004167 | 0.002083 | 8 | 0.004167 | 0.002083 |
| | | 0.002083 | | | 0.002083 |
| 5 | 0.002083 | 0.002083 | 7 | 0.002083 | 0.002083 |
| 4 | 0.001042 | 0.001042 | 6 | 0.001042 | 0.001042 |
| 3 | 0.00052083 | 0.00052083 | 5 | 0.00052083 | 0.00052083 |
| 2 | 0.00026041 | 0.00026041 | 4 | 0.00026041 | 0.00026041 |
| 1 | 0.000130208 | 0.000130208 | 3 | 0.000130208 | 0.000130208 |
| 0 | 0.000065104 | 0.000065104 | 2 | 0.000065104 | 0.000065104 |
| | | | 1 | 0.000032332 | 0.000032332 |
| | | | 0 | 0.000016276 | 0.000016276 |
| Data bits | | 12-bits | | | 14-bits |

The table above shows a re-mapping of the pulses of FIG. 2A corresponding to the bits of the color to be represented into equal value time slots by sub dividing the MSB bit times and adding together others. The MSB pulse is divided into four 0.0020833 second time periods. The five least significant bits for 8-bit color and seven least significant bits for 10-bit color may be added together for 0.00206705 sec (0.0020833 minus the LSB). In one embodiment, the seven equal time periods represent 7/8s of the frame time; however, other portions of the frame time may be occupied by the pulse segments that precede the reference time.

At step 168, some FTPs 124, 128, and/or 130 are located within time frame 105 to time periods different from those of FIG. 2A so that a continuous chain of FTPs 124, 128, and 130 may be formed that ends at reference time 120. FTPs may be processed in other ways that generate a continuous chain of FTPs at a start time that equals a reference time minus the total duration of the FTPs. For example, a continuous chain of FTPs 124 and 128 associated with decimal number 11 would be initiated at time "4" along horizontal axis 104 because the time value of reference time 120 is "12" and the total value of FTPs 124 and 128 is "8" (12 minus 8 equals 4).

At step 170, respective pulses that follow reference time 120 are combined to form VTP 132 for each binary number. The particular VTP 132 of each binary number may not be equal in duration to those of other VTPs 142. For some binary numbers, such as binary numbers "0100," "1000," "1100," and "0000," VTP 132 may not exist. Additional details regarding one implementation of calculating VTP 132 are provided below in conjunction with FIG. 5. At step 174, a continuous chain of FTPs 124, 128, and/or 130 and VTP 132 are joined at reference time 120 to form a continuous pulse chain. The resulting continuous pulse chain is also referred to as a "single pulse."

In one embodiment, method 150 also includes steps 178 through 180; however, steps 178 through 180 may be omitted in some embodiments. At step 178, each of segments 124, 128, 130, and 132 for a given pixel is displayed in only a particular sector of screen 18 depending upon the time within time frame 105. Then at step 180, segments 124, 128, 130, and 132 are continuously rotated in this manner so that each sector displays a particular segment only one quarter of the time. This is advantageous in some embodiments because VTP 132, the formation of which requires calculations, is performed only a fraction of the time. Thus, bandwidth is saved. Additional details concerning steps 178 and 180 are described in conjunction with FIG. 6. Method 150 stops at step 178.

Although some embodiments of the present invention have been described in detail, it should be understood that various changes, substitutions, and alterations can be made hereto without departing from the spirit and scope of the invention as defined by the appended claims.

What is claimed is:

1. A method for displaying eight-bit color on a plurality of pixels on a monitor comprising:

for each pixel:

receiving a value indicative of one of a plurality of possible values for the level of intensity desired to be displayed on the pixel, the value representable by eight binary bits including a least significant bit;

during a given time frame, providing an on state for the pixel for a continuous fractional portion of the given time frame, the fractional portion being indicative of the received value, the given time frame comprising a fixed portion equal to approximately 224/255 of the given time frame followed by a variable portion equal to approximately 31/255 of the given time frame, wherein providing an on state for the pixel for a continuous fraction portion of the given time frame comprises, during the fixed time portion, changing the on or off state of the pixel, if at all, only at time intervals corresponding to approximately 32/255 of the time frame, the on or off state of the pixel based solely on the three most significant bits of the value and independent of the least significant bit of the value; and further comprising determining whether to turn the pixel off during the variable portion, including, during the variable time portion, turning the pixel off, if at all, only at each of a plurality of predetermined time intervals during the variable time portion, the time intervals during the variable time portion having a duration approximately equal to the time frame divided by 255.

2. A method for displaying ten-bit color on a plurality of pixels on a monitor comprising:

for each pixel:

receiving a value indicative of one of a plurality of possible values for the level of intensity desired to be displayed on the pixel, the value representable by ten binary bits including a least significant bit;

during a given time frame, providing an on state for the pixel for a continuous fractional portion of the given time frame, the fractional portion being indicative of the received value, the given time frame comprising a fixed portion equal to approximately 896/1023 of the given time frame followed by a variable portion equal to approximately 127/1023 of the given time frame, wherein providing an on state for the pixel for a continuous fraction portion of the given time frame comprises, during the fixed time portion, changing the on or off state of the pixel, if at all, only at time intervals corresponding to approximately 128/1023 of the time frame, the on or off state of the pixel based solely on the three most significant bits of the value and independent of the least significant bit of the value; and further comprising determining whether to turn the pixel off during the variable portion, including, during the variable time portion, turning the pixel off, if at all, only at each of a plurality of predetermined time intervals during the variable time portion, the time intervals during the variable time portion having a duration approximately equal to the time frame divided by 1023.

3. A method for displaying N-bit color on a plurality of pixels on a monitor comprising:

for each pixel:

receiving a value indicative of one of a plurality of possible values for the level of intensity desired to be displayed on the pixel, the value representable by N binary bits including a least significant bit;

during a given time frame, providing an on state for the pixel for a continuous fractional portion of the given time frame, the fractional portion being indicative of the received value, the given time frame comprising a fixed portion equal to approximately $m/2^N-1$ of the given time frame followed by a variable portion equal to approximately $$\frac{2^N - 1 - m}{2^N - 1}$$

of the given time frame, wherein providing an on state for the pixel for a continuous fraction portion of the given time frame comprises, during the fixed time portion, changing the on or off state of the pixel, if at all, only at time intervals corresponding to approximately $$\frac{2^N - m + 1}{2^N - 1}$$

of the time frame, the on or off state of the pixel independent of the least significant bit of the value;

further comprising determining whether to turn the pixel off during the variable portion, including, during the variable time portion, turning the pixel off, if at all, only at each of a plurality of predetermined time intervals during the variable time portion, the time intervals during the variable time portion having a duration approximately equal to the time frame divided by $2^N-1$; and wherein m is between one and $2^N$ and $m/2^N-1$ is between about ½ and 1.

4. The method of claim 3, wherein N is 12 and m is 3072.

5. The method of claim 3, wherein N is 14 and m is 12288.

6. A method for displaying N-bit color on a plurality of pixels on a monitor comprising:

for each pixel:

receiving a value indicative of one of a plurality of possible values for the level of intensity desired to be displayed on the pixel, the value representable by N binary bits including a least significant bit, the plurality of possible values including at least sixteen consecutive possible values;

for any of the at least sixteen consecutive possible values of the level of intensity, during a given time frame, providing an on state for the pixel for a single continuous portion of the given time frame, the given time frame comprising a fixed portion followed by a variable portion; and wherein, for any of the at least sixteen consecutive possible values for the level of intensity, the time at which the pixel is turned on during the fixed portion, if at all, is independent of the least significant bit.

7. The method of claim 6, wherein providing an on state for the pixel for a continuous fractional portion of the given time frame comprises, during the fixed time portion, changing the on or off state of the pixel, if at all, only at each of a plurality of predetermined time intervals within the fixed portion, the time intervals each being greater than the length of the time frame divided by the number of the plurality of bits.

8. The method of claim 7, wherein each of the plurality of time intervals is the same.

9. The method of claim 8, wherein each of the plurality of time intervals is equal to approximately the time frame divided by N.

10. The method of claim 9, wherein the variable portion of the given time frame is equal to approximately the time frame divided by N.

11. The method of claim 7, wherein N is eight and the length of the each of the time intervals is approximately one eight of the given time frame.

12. The method of claim 7, wherein N is ten and the length of each of the time intervals is approximately 1/32 of the given time frame.

13. The method of claim 7, wherein changing the on or off state of the pixel, if at all, only at each of a plurality of predetermined time intervals within the fixed portion comprises examining the two most significant bits of the value, and wherein the on or off state of the pixel is independent of bits of lesser significance than the two most significant bits.

14. The method of claim 7, wherein changing the on or off state of the pixel, if at all, only at each of a plurality of predetermined time intervals within the fixed portion comprises examining the three most significant bits of the value, and wherein the on or off state of the pixel is independent of bits of lesser significance than the two most significant bits.

15. The method of claim 11, wherein changing the on or off state of the pixel, if at all, only at each of a plurality of predetermined time intervals within the fixed portion comprises examining the two most significant bits of the value, and the on or off state of the pixel is independent of the five least significant bits of the value.

16. The method of claim 12, wherein changing the on or off state of the pixel, if at all, only at each of a plurality of predetermined time intervals within the fixed portion comprises examining the three most significant bits of the value, and the on or off state of the pixel is independent of the seven least significant bits of the value.

17. The method of claim 6, and further comprising turning the pixel off during the variable portion.

18. The method of claim 17, wherein turning the pixel off during the variable portion comprises, during the variable time portion, turning the pixel off only at each of a plurality of predetermined time intervals during the variable time portion, the time intervals during the variable time portion having a duration less than approximately the given time frame divided by N.

19. A method for driving a pixel, comprising:

providing a logic operable to, receive an indication of a desired level of light intensity and storing the indication as one of a plurality of binary numbers, the binary numbers each having at least four bits and representing a particular level of light intensity during a frame time period, wherein each binary number has a plurality of most significant bits and a plurality of least significant bits, each of the most significant bits and each of the least significant bits associated with a particular time duration, the plurality of binary numbers comprising at least sixteen consecutive binary numbers, generate, for each of at least twelve of the consecutive binary numbers, a plurality of continuous pulse chains each corresponding to a particular one of the binary numbers and having a designated start time within the frame time period, each of the continuous pulse chains having a duration represented by the most significant bits of the particular one of the binary numbers and concluding at a stop time, wherein any of the generated continuous pulse chains shorter in duration than another one of the generated continuous pulse chains has a later start time within the frame time period than the start time of the another one of the generated continuous pulse chains, and wherein the later start time is later than the start time by a time interval, the time interval equal to an integer multiple of the particular time duration of the least significant one of the most significant bits, and generate a plurality of variable timing pulses each corresponding to the particular one of the binary numbers and having a start time within the frame time period that is immediately after the stop time of a corresponding one of the continuous pulse chains, the each of the plurality of variable timing pulses generated according to a time duration represented by the least significant bits of the particular one of the binary numbers;

receiving the indication at the logic;

storing the indication as the binary number; and generating a single pulse having a duration indicative of the desired level of light intensity to drive the pixel to the particular level of light intensity.

20. The method of claim 19, wherein the stop time is within the later half of the frame time period.

21. The method of claim 19, wherein the stop time is at a time that is seven-eighths of the frame time period.

22. The method of claim 19, wherein the stop time of the each generated continuous pulse chain leaves a time period equal to a difference between the particular time duration associated with the least significant one of the most significant bits and the particular time duration of the least significant one of the least significant bits.

23. The method of claim 19, wherein the plurality of binary numbers each comprises eight bits and the plurality of most significant bits consists of the first three of the eight bits.

24. The method of claim 19, wherein the plurality of binary numbers each comprises ten bits and the plurality of most significant bits consists of the first three of the ten bits.

25. The method of claim 19, wherein the most significant one of the plurality of most significant bits is associated with the particular time duration that is approximately one half of the frame time period.

26. The method of claim 19, and further comprising:

dividing a display screen into a number of sectors equal to the number of the at least four bits, each of the sectors comprising a pixel;

driving the pixel of only one of the sectors with one of the variable timing pulses during the frame time period; and driving another pixel of only another one of the sectors with the one of the variable timing pulses during a following frame time period.

27. A method for driving a pixel, comprising:

receiving an indication of a desired level of light intensity and storing the indication as one of a plurality of binary numbers, the plurality of binary numbers each having at least four bits and representing a particular level of light intensity during a frame time period, wherein each binary number has a plurality of most significant bits and a plurality of least significant bits, each of the most significant bits and each of the least significant bits associated with a particular time duration, the plurality of binary numbers comprising at least sixteen consecutive binary numbers;

generating, for any of at least twelve of the consecutive binary numbers, a plurality of continuous pulse chains each corresponding to a particular one of the binary numbers and having a designated start time within the frame time period, each of the continuous pulse chains having a duration represented by the most significant bits of the particular one of the binary numbers and concluding at a stop time, wherein any of the generated continuous pulse chains shorter in duration than another one of the generated continuous pulse chains has a later start time within the frame time period than the start time of the another one of the generated continuous pulse chains, and wherein the later start time is later than the start time by a time interval, the time interval equal to an integer multiple of the particular time duration of the least significant one of the most significant bits; and generating a plurality of variable timing pulses each corresponding to the particular one of the binary numbers and having a start time within the frame time period that is immediately after the stop time of a corresponding one of the continuous pulse chains, the each of the plurality of variable timing pulses generated according to a time duration represented by the least significant bits of the particular one of the binary numbers.

28. The method of claim 27, wherein the stop time is within the later half of the frame time period.

29. The method of claim 27, wherein the stop time is at a time that is seven-eighth of the frame time period.

30. The method of claim 27, wherein the stop time of the each continuous pulse chain leaves a time period equal to a difference between the particular time duration associated with the least significant one of the most significant bits and the particular time duration of the least significant one of the least significant bits.

31. The method of claim 27, wherein the plurality of binary numbers each comprises eight bits and the plurality of most significant bits consists of the first three of the eight bits.

32. The method of claim 27, wherein the plurality of binary numbers each comprises ten bits and the plurality of most significant bits consists of the first three of the eight bits.

33. The method of claim 27, and further comprising:

dividing a display screen into a number of sectors equal to the number of the at least four bits, each of the sectors comprising a pixel;

driving the pixel of only one of the sectors with one of the variable timing pulses during the frame time period; and driving another pixel of only another one of the sectors with the one of the variable timing pulses during a following frame time period.

34. A system for driving a pixel, comprising:

a display unit having a display screen, the display screen comprising a plurality of pixels;

a logic unit coupled to the display screen and operable, when executed, to:

receive an indication of a desired level of light intensity and storing the indication as one of a plurality of binary numbers, the plurality of binary numbers each having at least four bits and representing a particular level of light intensity during a frame time period, wherein each binary number has a plurality of most significant bits and a plurality of least significant bits, each of the most significant bits and each of the least significant bits associated with a particular time duration, the plurality of binary numbers comprising at least sixteen consecutive binary numbers;

generate, for each of at least twelve of the consecutive binary numbers, a plurality of continuous pulse chains each corresponding to a particular one of the binary numbers and having a designated start time within the frame time period, each of the continuous pulse chains having a duration represented by the most significant bits of the particular one of the binary numbers and concluding at a stop time, wherein any of the generated continuous pulse chains shorter in duration than another one of the generated continuous pulse chains has a later start time within the frame time period than the start time of the another one of the generated continuous pulse chains, wherein the later start time is later than the start time by a time interval, the time interval equal to an integer multiple of the particular time duration of the least significant one of the most significant bits; and generate a plurality of variable timing pulses each corresponding to the particular one of the binary numbers and having a start time within the frame time period that is immediately after the stop time of a corresponding one of the continuous pulse chains, the each of the plurality of variable timing pulses generated according to a time duration represented by the least significant bits of the particular one of the binary numbers.

35. The system of claim 34, wherein the stop time is at a time that is seven-eighth of the frame time period.

36. The system of claim 34, wherein the stop time of the each continuous pulse chain leaves a time period equal to a difference between the particular time duration associated with the least significant one of the most significant bits and the particular time duration of the least significant one of the least significant bits.

37. The system of claim 34, wherein the plurality of binary numbers each comprises eight bits and the plurality of most significant bits consists of the first three of the eight bits.

38. The system of claim 34, wherein the logic unit is further operable to:

divide a display screen into a number of sectors equal to the number of the at least four bits, each of the sectors comprising a pixel;

drive the pixel of only one of the sectors with one of the variable timing pulses during the frame time period; and drive another pixel of only another one of the sectors with the one of the variable timing pulses during a following frame time period.

* * * * *